US010205266B1

(12) United States Patent
Peterson et al.

(10) Patent No.: US 10,205,266 B1
(45) Date of Patent: Feb. 12, 2019

(54) CONNECTOR WIRE DRESS COVER FOR ROBOTIC INSTALLATION

(71) Applicant: Aptiv Technologies Limited, St. Michael (BB)

(72) Inventors: David R. Peterson, Aurora, OH (US); Joseph Sudik, Jr., Niles, OH (US)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 15/797,081

(22) Filed: Oct. 30, 2017

(51) Int. Cl.

| | |
|---|---|
| ***H01R 13/516*** | (2006.01) |
| ***H01R 25/00*** | (2006.01) |
| ***H01B 7/00*** | (2006.01) |
| ***H01R 25/16*** | (2006.01) |

(52) U.S. Cl.
CPC ..... *H01R 13/516* (2013.01); *H01B 7/0045* (2013.01); *H01R 25/003* (2013.01); *H01R 25/162* (2013.01)

(58) Field of Classification Search
CPC .. H01R 13/501; H01R 13/516; H01R 25/003; H01R 25/162; H01B 7/0045
See application file for complete search history.

(56) References Cited

U.S. PATENT DOCUMENTS

| | | | | |
|---|---|---|---|---|
| 5,023,752 | A | 6/1991 | Detter et al. | |
| 5,207,587 | A | 5/1993 | Hamill et al. | |
| 5,391,092 | A * | 2/1995 | Sumida | H01R 13/516 439/470 |
| 5,823,798 | A | 10/1998 | Zintler et al. | |
| 5,993,246 | A * | 11/1999 | Moldenhauer | H01R 13/501 439/474 |
| 6,077,102 | A | 6/2000 | Borzi et al. | |
| 6,270,376 | B1 | 8/2001 | Fink et al. | |
| 6,305,957 | B1 | 10/2001 | Fink et al. | |
| 6,361,356 | B1 | 3/2002 | Heberlein et al. | |
| 6,962,504 | B2 * | 11/2005 | Fukui | H01R 13/562 439/466 |
| 8,882,521 | B2 | 11/2014 | Conway et al. | |
| 2005/0106911 | A1 | 5/2005 | Sharples et al. | |
| 2006/0099851 | A1 * | 5/2006 | Duarte | H01R 13/567 439/502 |
| 2009/0020309 | A1 * | 1/2009 | Foltz | H02G 3/0487 174/97 |
| 2012/0302085 | A1 * | 11/2012 | Kyoyama | H01R 13/516 439/357 |

(Continued)

FOREIGN PATENT DOCUMENTS

| | | |
|---|---|---|
| DE | 2836166 B | 11/1979 |
| DE | 4422434 C | 7/1995 |

*Primary Examiner* — James Harvey
*Assistant Examiner* — Oscar Jimenez
(74) *Attorney, Agent, or Firm* — Robert J. Myers

(57) ABSTRACT

A wiring-harness includes a wire cable, a connector, and a dress cover. The connector is attached to a portion of the wire cable. The connector has a terminal-face and a wire-cable-face with a body between the terminal-face and the wire-cable-face. The dress cover is attached to a portion of the body. An extension of the dress-cover overlays the wire-cable-face. The extension is configured to guide the wire cable in a predetermined direction. The extension is further configured to be releasably retained by a robotic assembler. The dress cover is further configured to transmit an insertion-force from the robotic assembler to the connector when the terminal-face is inserted into a mating-connector.

19 Claims, 5 Drawing Sheets

(56) References Cited

U.S. PATENT DOCUMENTS

| | | | | |
|---|---|---|---|---|
| 2014/0045361 | A1* | 2/2014 | Gunreben ..... | H01R 13/6273<br>439/345 |
| 2015/0162693 | A1* | 6/2015 | Ng ..... | H01R 13/5812<br>439/586 |

* cited by examiner

CONNECTOR WIRE DRESS COVER FOR ROBOTIC INSTALLATION

TECHNICAL FIELD OF INVENTION

This disclosure generally relates to a connector wire dress cover, and more particularly relates to a connector wire dress cover for robotic installation.

BRIEF DESCRIPTION OF DRAWINGS

The present invention will now be described, by way of example with reference to the accompanying drawings, in which.

DETAILED DESCRIPTION

Figure 1:
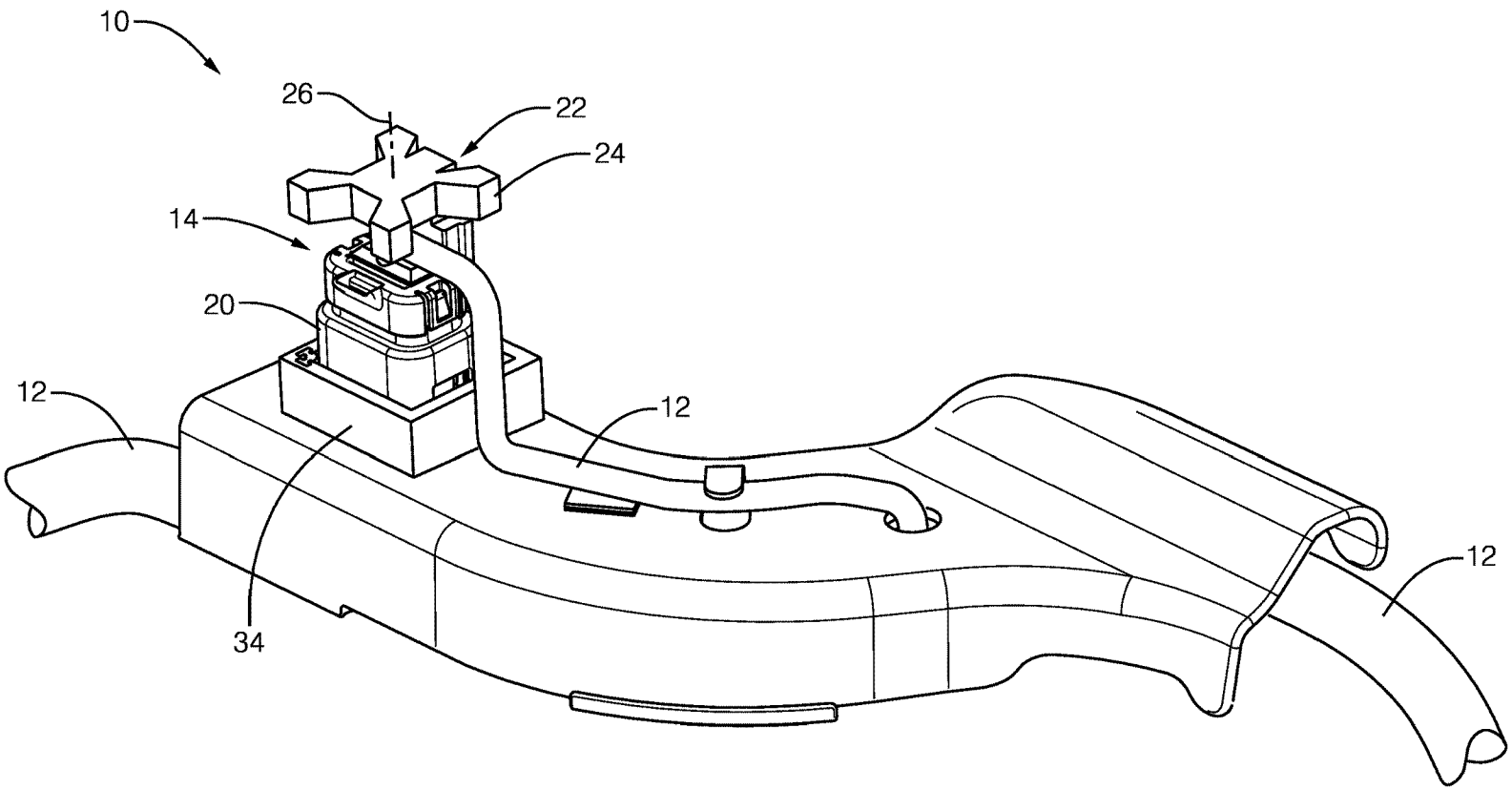
FIG. 1 is an illustration of a wiring-harness in accordance with one embodiment.

FIG. 1 illustrates a wiring-harness 10. As will be described in more detail below, the wiring-harness 10 is an improvement over other wiring harnesses because the wiring-harness 10 enables an automated installation into a vehicle, for example by using a robotic installation tool. The wiring-harness 10 may be attached to a main-branch (not shown) that is a component of the vehicle's electrical system.

The wiring-harness 10 includes a wire cable 12 that includes a plurality of electrical wires. Alternatively wire cable 12 may be a single electrical wire. The wire cable 12 is attached to the wiring-harness 10 and connects electrical components, such as sensors, switches, or control modules (not shown) to the vehicle electrical system through the wiring-harness 10.

The wiring-harness 10 also includes a connector 14 attached to a portion (e.g. branch, break-out) of the wire cable 12. The connector 14 has a terminal-face 16 (see FIG. 3A) and a wire-cable-face 18 (see FIG. 3B) with a body 20 between the terminal-face 16 and the wire-cable-face 18. The terminal-face 16 of the connector 14 interfaces with a mating-connector (not shown), and the wire-cable-face 18 has wire egress openings.

The wiring-harness 10 also includes a dress cover 22 attached to a portion of the body 20 of the connector 14. In the example illustrated in FIG. 1, the dress cover 22 is attached to a typical connector-position-assurance (CPA) attachment feature 23 (see FIG. 3A) formed in the body 20 of the connector 14 configured to retain a CPA device (not shown), as will be described in more detail below. An extension 24 of the dress cover 22 overlays the wire-cable-face 18 and is configured to guide the wire cable 12 in a predetermined direction. The extension 24 extends across the wire-cable-face 18 at an angle of 90 degrees relative to a mating-axis 26 of the connector 14. Alternatively, the extension 24 may extend across the wire-cable-face 18 at any angle, including obtuse angles and acute angles, as required by the installation process. The extension 24 inhibits the wire cable 12 from becoming entangled or interfering with an end-effector 28 of a robotic assembler 30 (see FIG. 2) while also controlling the wire egress.

Figure 2:
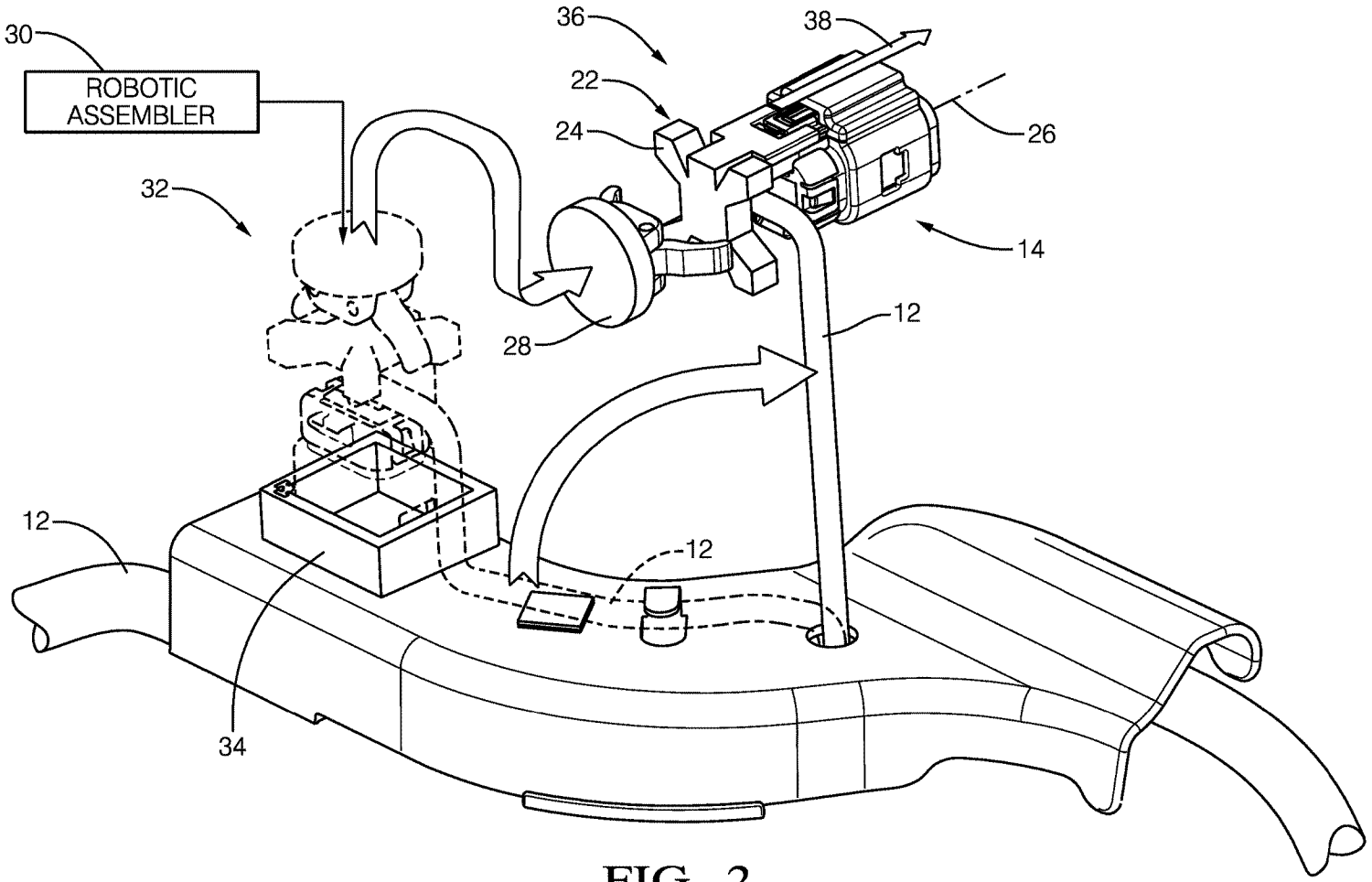
FIG. 2 is an illustration of a progression of an installation sequence of the wiring-harness of FIG. 1 in accordance with one embodiment.

FIG. 2 illustrates a progression of an installation sequence using the robotic assembler 30 where only the end-effectors 28 are illustrated for clarity. At a first-position 32, the end-effector 28 of the robotic assembler 30 is poised to grasp the extension 24 with the connector 14 retained in a staging-device 34. The extension 24 is configured to be releasably retained (i.e., grasped and released) by the robotic assembler 30, as will be described in more detail below. At a second-position 36, the robotic assembler 30 has removed the connector 14 from the staging-device 34 (with the wire cable 12 attached) and has attached the connector 14 to the mating-connector (not shown), after which the end-effector 28 releases the extension 24.

The dress cover 22 is further configured to transmit an insertion-force 38 from the robotic assembler 30 to the connector 14 when the terminal-face 16 is inserted into the mating-connector. The insertion-force 38 is typically less than 135 Newtons (135 N) to comply with ergonomic constraints of any service procedures that may later be performed by humans, and is preferably in a range between 60 N to 100 N.

Figure 3A:
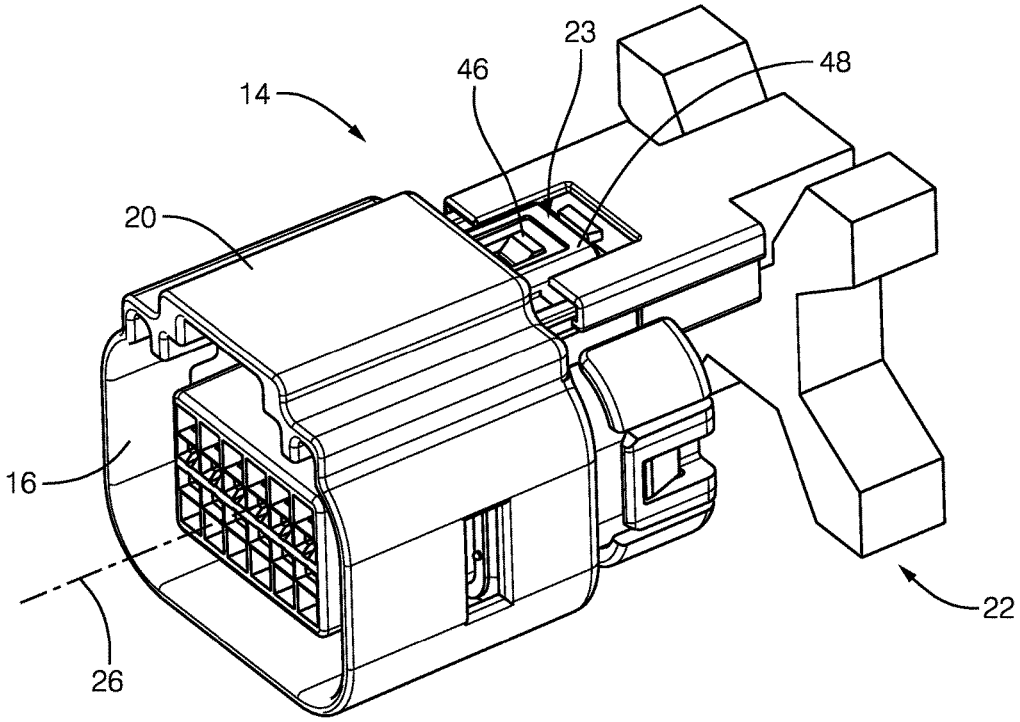
FIG. 3A is an illustration of a perspective view of a connector and dress cover from the wiring-harness of FIG. 1 in accordance with one embodiment.
Figure 3B:
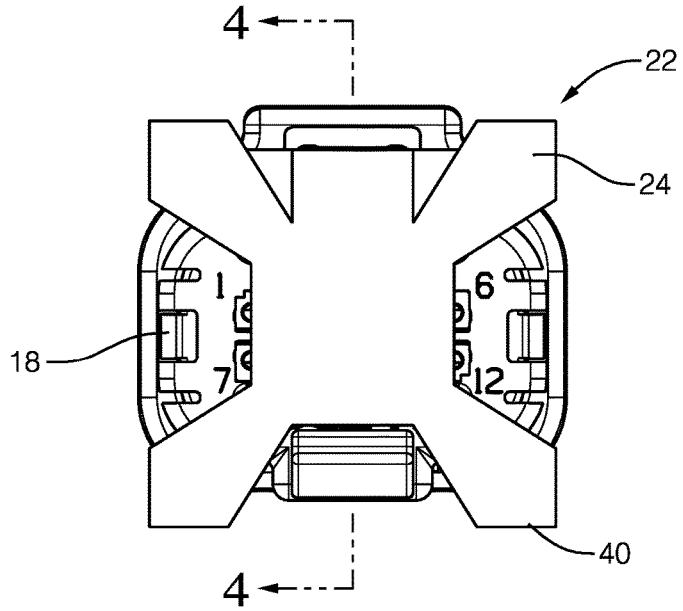
FIG. 3B is an illustration of a rear view of the connector and dress cover of FIG. 3A in accordance with one embodiment.

FIGS. 3A-3B illustrate the connector 14 with the dress cover 22 attached, and isolated from the wire cable 12. The extension 24 is characterized as having an X-shape 40, and is configured to be releasably retained by the robotic assembler 30 in at least one of two different positions. This has the technical benefit of enabling the robotic assembler 30 flexibility to determine a proper orientation for positioning the end-effector 28 to grasp the extension 24, taking into account any axial and/or rotational constraints of the installation environment. Other shapes of the extension 24 which are contemplated, but not shown, are polygonal, multi-faceted, shapes, for example square, hexagonal, pentagonal, and octagonal shapes. The dress cover 22 may be left in place on the connector 14 or may be removed after insertion into the mating-connector.

Figure 4:
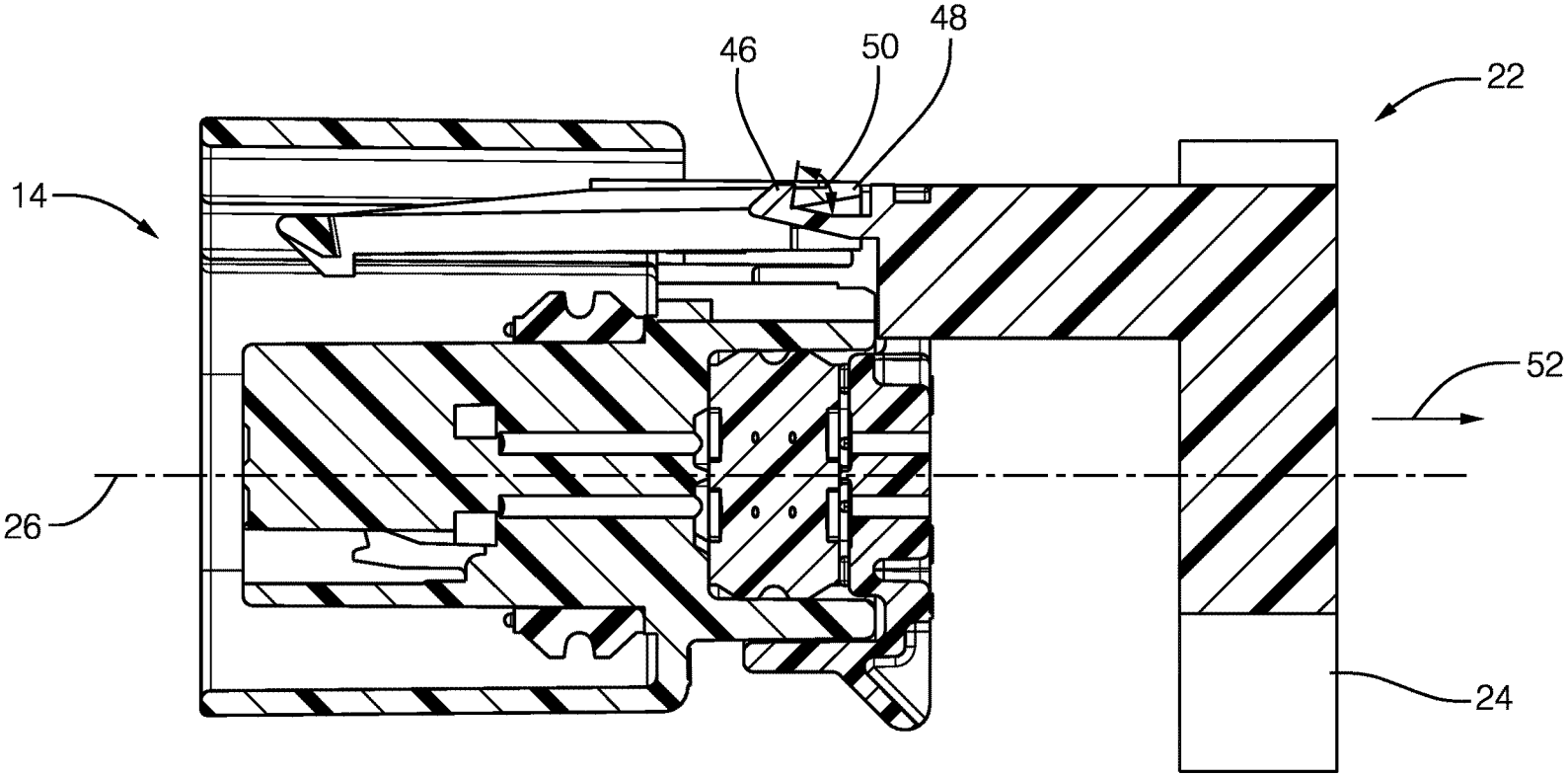
FIG. 4 is an illustration of a cross section view of the connector and dress cover of FIG. 3A in accordance with one embodiment.

FIG. 4 is a cross section view of the connector 14 and dress cover 22 of section 4-4 of FIG. 4 and illustrates a locking-tab 46 of the dress cover 22 engaged with a locking-ramp 48 of the connector 14. The dress cover 22 may be configured such that a dress-cover-pullout-force-threshold 42 required to separate the dress cover 22 from the connector 14 is less than the a mating-connector-pullout-force-threshold 44 required to separate the connector 14 from the mating-connector. For example, a face-angle 50 of a face of the locking-tab 46, wherein the face of the locking-tab 56 defines an interface between the locking-tab 46 and the locking-ramp 48, may be configured to permit the locking-tab 46 to disengage from the locking-ramp 48 when a pull-out force 52 that exceeds the dress-cover-pullout-force-threshold 42 is applied to the dress cover 22.

Alternatively, the dress cover 22 may further include a frangible feature 54 (see FIG. 5A) that enables a portion of the dress cover 22 to fracture when the pull-out force 52 applied to the dress cover 22 by the robotic assembler 30 exceeds the dress-cover-pullout-force-threshold 42. For example, the locking-tab 46 may include a zone of reduced cross section and/or stress concentrating features that is configured to initiate the fracture in response to the pull-out force 52.

The dress cover 22 may also be removable from the connector 14 only after the connector 14 is properly mated with the mating-connector, similar to the function of the CPA device. The locking-tab 46 of the dress cover 22 may be extended (not shown) to engage a leading-edge of the mating-connector such that the leading-edge disengages the locking-tab 46 from the locking-ramp 48 of the connector 14, thereby enabling the dress cover 22 to be removed from the connector 14.

Figure 5A:
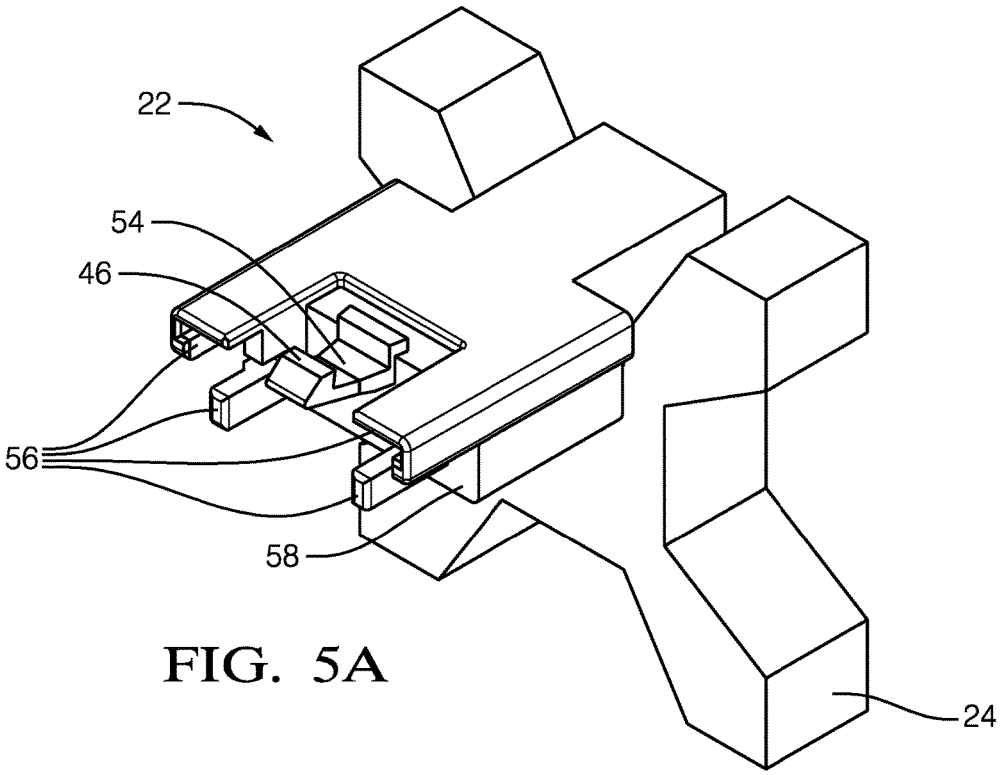
FIG. 5A is an illustration of a perspective view of the dress cover of FIG. 4 in accordance with one embodiment.
Figure 5B:
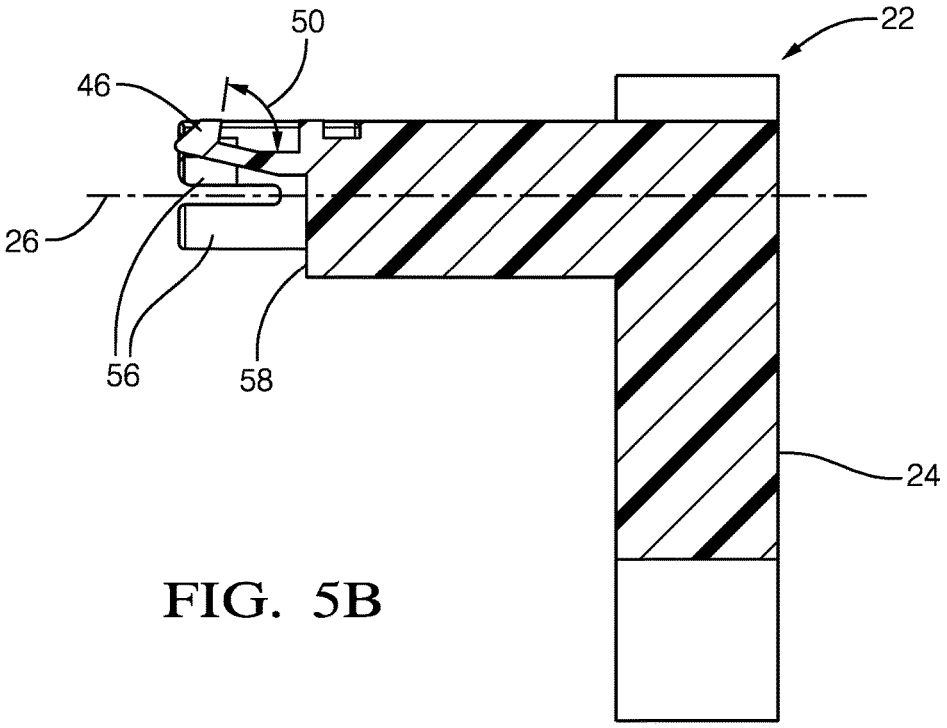
FIG. 5B is an illustration of a cross section view of the dress cover of FIG. 4 in accordance with one embodiment.

FIGS. 5A-5B illustrate the dress cover 22 isolated from the connector 14. FIG. 5A is a perspective view of the dress cover 22 and more clearly shows the locking-tab 46 and surrounding beams 56 that engage the body 20 of the connector 14 and inhibit a rotation of the dress cover 22 relative to the connector 14. The dress cover 22 defines a shoulder 58 that is configured to transmit the insertion-force 38 from the robotic assembler 30 to the body 20 of the connector 14 as described above.

FIG. 5B is the cross section view of the dress cover 22 of section 4-4 from FIG. 4, and illustrates the extension 24 oriented at the 90 degree angle relative to the mating-axis 26 of the connector 14. Alternatively, the extension 24 may be oriented parallel to the mating-axis 26 of the connector 14 and still permit the dress cover 22 to transmit the insertion-force 38 from the robotic assembler 30 to the connector 14. The parallel orientation of the extension 24 relative to the mating-axis 26 may be useful for installations where the end-effector 28 cannot be positioned directly behind the connector 14.

FIG. 5A also more clearly illustrates the frangible feature 54 of the locking-tab 46 that enables a portion of the dress cover 22 to fracture when the pull-out force 52 applied to the dress cover 22 by the robotic assembler 30 exceeds the dress-cover-pullout-force-threshold 42.

Accordingly, a wiring-harness 10 and a wire dress cover 22 are provided. The wiring-harness 10 provides a dress cover 22 with features that are compatible with installation into the vehicle by the robotic assembler 30. The wire dress cover 22 is designed to utilize existing CPA attachment features 23 on the connector 14 and does not require a unique connector-design or unique connector-tooling.

While this invention has been described in terms of the preferred embodiments thereof, it is not intended to be so limited, but rather only to the extent set forth in the claims that follow. Moreover, the use of the terms first, second, upper, lower, etc. does not denote any order of importance, location, or orientation, but rather the terms first, second, etc. are used to distinguish one element from another. Furthermore, the use of the terms a, an, etc. do not denote a limitation of quantity, but rather denote the presence of at least one of the referenced items.

We claim:

1. A wiring-harness, comprising:

a wire cable;

a connector attached to a portion of the wire cable, the connector having a terminal-face and a wire-cable-face with a body therebetween; and a dress cover attached to a connector-position-assurance attachment feature formed in the body, said dress cover having a locking-tab and surrounding beams that engage the body, wherein an extension of the dress cover overlays the wire-cable-face, the extension configured to guide the wire cable in a predetermined direction, the extension further configured to be releasably retained by a robotic assembler and inhibit the wire cable from contacting an end-effector of the robotic assembler, wherein the dress cover is further configured to transmit an insertion-force from the robotic assembler to the connector when the terminal-face is inserted into a mating-connector.

2. The wiring-harness in accordance with claim 1, wherein the extension is characterized as having an X-shape.

3. The wiring-harness in accordance with claim 1, wherein the extension extends across the wire-cable-face at an angle of 90 degrees relative to a mating-axis of the connector.

4. The wiring-harness in accordance with claim 1, wherein the insertion-force is less than 135 Newtons.

5. The wiring-harness in accordance with claim 4, wherein the insertion-force is in a range between 60 Newtons to 100 Newtons.

6. The wiring-harness in accordance with claim 1, wherein the extension of the dress cover is configured to be releasably retained by the robotic assembler in at least one of two different positions.

7. The wiring-harness in accordance with claim 1, wherein a dress-cover-pullout-force-threshold required to separate the dress cover from the connector is less than a mating-connector-pullout-force-threshold required to separate the connector from the mating-connector.

8. The wiring-harness in accordance with claim 7, wherein the dress cover further includes a frangible feature that enables a portion of the dress cover to fracture when a pull-out force applied to the dress cover by the robotic assembler exceeds the dress-cover-pullout-force-threshold.

9. The wiring-harness in accordance with claim 1, wherein the dress cover is removable from the connector only after the connector is properly mated with the mating-connector.

10. A dress cover configured to be attached to a connector-position-assurance attachment feature formed in a body of a connector, said dress cover having a locking-tab and surrounding beams that engage the body, the dress cover including an extension, the extension configured to guide a wire cable of a wiring-harness in a predetermined direction, the extension further configured to be releasably retained by a robotic assembler and inhibit the wire cable from contacting an end-effector of the robotic assembler, wherein the dress cover is further configured to transmit an insertion-force from the robotic assembler to the connector when a terminal-face of the connector is inserted into a mating-connector.

11. The dress cover in accordance with claim 10, wherein the extension is characterized as having an X-shape.

12. The dress cover in accordance with claim 10, wherein the extension is oriented at an angle of 90 degrees relative to a mating-axis of the connector.

13. The dress cover in accordance with claim 10, wherein the extension is oriented parallel to a mating-axis of the connector.

14. The dress cover in accordance with claim 10, wherein the insertion-force is less than 135 Newtons.

15. The dress cover in accordance with claim 14, wherein the insertion-force is in a range between 60 Newtons to 100 Newtons.

16. The dress cover in accordance with claim 10, wherein the extension of the dress cover is configured to be releasably retained by the robotic assembler in at least one of two different positions.

17. The dress cover in accordance with claim 10, wherein a dress-cover-pullout-force-threshold required to separate the dress cover from the connector is less than a mating-connector-pullout-force-threshold required to separate the connector from the mating-connector.

18. The dress cover in accordance with claim 17, wherein the dress cover further includes a frangible feature that enables a portion of the dress cover to fracture when a pull-out force applied to the dress cover by the robotic assembler exceeds the dress-cover-pullout-force-threshold.

19. The dress cover in accordance with claim 10, wherein the dress cover is removable from the connector only after the connector is properly mated with the mating-connector.

* * * * *